US005845376A

United States Patent [19]

Tung

[11] Patent Number: 5,845,376

[45] Date of Patent: Dec. 8, 1998

[54] SIDE RELEASE BUCKLE

[76] Inventor: Chen Chang Tung, P.O. Box 63-150, Taichung, Taiwan

[21] Appl. No.: 854,858

[22] Filed: May 12, 1997

[51] Int. Cl.[6] ..... A44B 11/26

[52] U.S. Cl. ..... 24/625; 24/651

[58] Field of Search ..... 24/614, 615, 625, 24/651

[56] References Cited

U.S. PATENT DOCUMENTS

| | | | |
|---|---|---|---|
| 5,144,725 | 9/1992 | Krauss | 24/625 |
| 5,311,649 | 5/1994 | Suh | 24/625 |
| 5,355,562 | 10/1994 | Matoba et al. | 24/625 |
| 5,383,257 | 1/1995 | Krauss | 24/625 |
| 5,419,020 | 5/1995 | Murai | 24/625 |
| 5,465,472 | 11/1995 | Matoba | 24/625 |
| 5,548,879 | 8/1996 | Wu | 24/625 |

*Primary Examiner*—James R. Brittain

[57] ABSTRACT

A side release buckle is composed of a female part and a male part. The female part has a compressive device consisting of a spindle, a compression spring, and a wedge-shaped element. The male part has two latching elements and two locking elements and is capable of reaching a preset depth in the course of buckling action such that the locking elements come into contact with the wedge-shaped element of the compressive device of the female part, and that the locking elements move apart by the slope of the wedge-shaped element so as to move in a curving form until the locking elements press against the latching elements, and further that the male part and the female part are buckled.

1 Claim, 3 Drawing Sheets

SIDE RELEASE BUCKLE

BACKGROUND

The invention involves an embodiment of a side release buckle, especially, an improved side release buckle.

Figure 1:
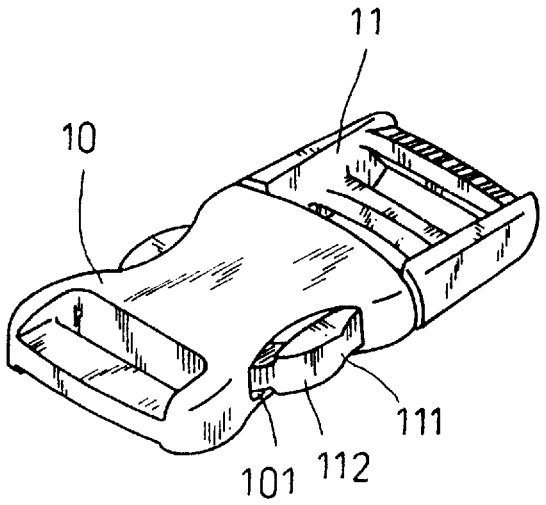
FIG.1 PRIOR ART

A common buckle, as shown in FIG. 1, consists mainly of a female part (10) and a male part (11). The female part (10) is made hollow with a shaped opening (101) properly at each side. The male part (11) has a pair of integrally and symmetrically shaped latching elements (111). When snapping connection is expected, the two latching elements (111) of the male part (11) can be inserted in the hollow inside of the female part (10) with their shaped hooks (112) at ends clasping on the edge of the openings (101) to join the two parts together. However, the construction mentioned above has a major shortcoming, i.e. a common buckle can work quickly by its female part (10) and mate part (11), such a buckling joint is not secure because the latching elements (111) will be out of snapped joint by accidental depression on them. As soon as the latching elements (111) are out of buckling joint, the female part (10) and the male part (11) will be separated apart resulting inpossible losing of carried goods. Therefore, such a construction with the serious shortcoming have to be improved.

Based on detailed considerations and the rich experience on development of various buckles and their relevant elements an improved buckle construction is developed by the inventor.

The primary object of the invention is to provide an improved side release buckle in which such a locking mechanism is provided to prevent the female and male parts in buckling status from separation by accidental depression that a secure snapped joint can be obtained.

An improved side release buckle provided by the invention includes:

A female part which is made hollow with a shaped opening property at each side;

A mate part which has a pair of integrally and symmetrically shaped latching elements which can be inserted in the hollow inside of the female part with their shaped hooks clasping on the edge of the opennings to join the two parts together;

A feature of the invention is that the male part has a pair of integrally shaped locking elements between the two latching elements so that in buckling action the locking elements can property lock the latching elements; that the female part has an integrally shaped guide on its internal wall and a retainer near its bottom for a compressive device that consists of a spindle, a compression spring, and a pushing/pulling element with the compression spring and the pushing/pulling element placed over the spindle. In order to make the pushing/pulling element moving along a certain trace a leading element which is inserted in the guide on the internal wall of the female part is provided on the side of the pushing/pulling element opposite to the guide. So, in buckling action of the mate and female parts when the male part reaches a present depth and as soon as the two locking elements come into contact with the pushing/pulling element of the compressive device of the female part, the two locking elements will be split apart by the slope of the pushing/pulling element and move in a curving form until they press corespondingly against the two latching elements while the male and female parts get into a buckling position so that a secure buckling joint may be ensured without possibly accidental separation.

The object, feature and other advantages of the invention can be embodied in detail by a practical example and following figures.

FIG. 1 Three Dimensional Construction of commen buckle

Figure 2:
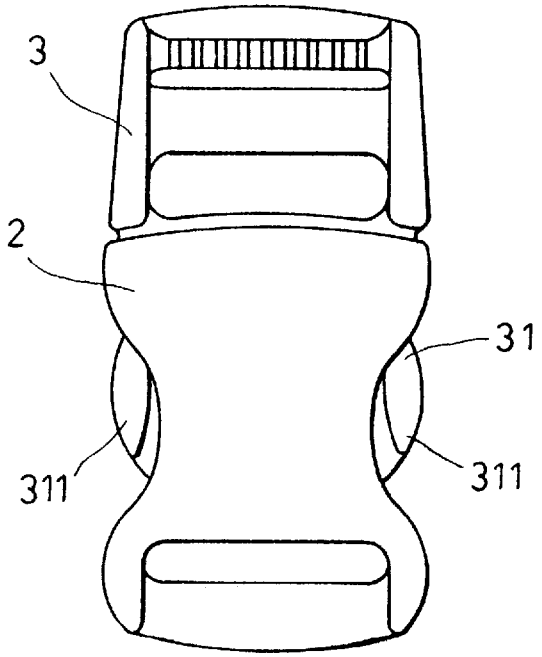

FIG. 2 Schematic Drawing of the Invention

Figure 3:
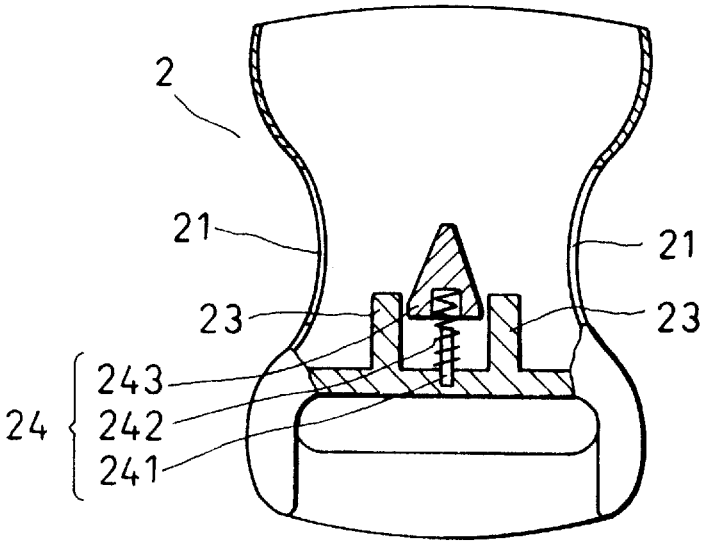

FIG. 3 Longitudinal Section of Female Part of the invention

Figure 4:
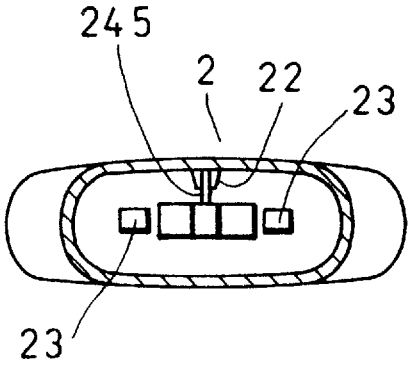

FIG. 4 Cross Section of Female part of the Invention

Figure 5:
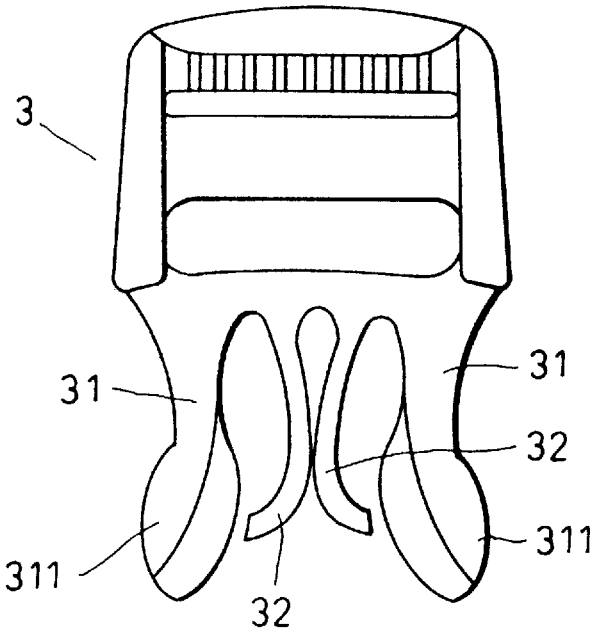

FIG. 5 Schematic Drawing of Male part of the Invention

Figure 6:
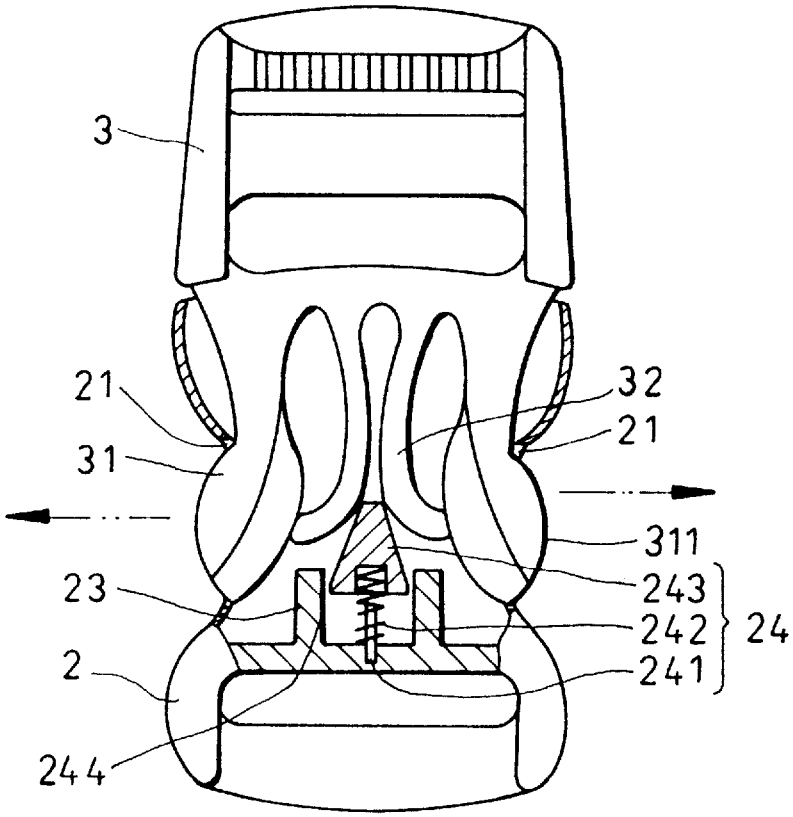

FIG. 6 Schematic Section of the Invention

An improved side release buckle provided by the invention consists of a female part (2) and a male part (3),in which:

The female part (2) is made hollow with a shaped opening (21) properly at each side, especially, the female part (2) has an integrally shaped guide (22) on its internal wall and a compressive device (24) properly near its bottom which consists of a spindle (241), a compression spring (242) and a pushing/pulling-element (243). The spindle is fixed in a retainer (23) that locates near the bottom of the female part (2). The compression spring (242) is placed over the spindle (241) and the pushing/pulling element (243) is also fixed on the end of the spindle (241). In order to make the pushing/pulling element (243) moving along a certain trace a leading element (245) which is inserted in the guide (22) on the internal wall of the female part (2) is provided on the side of the pushing/pulling element (243) opposite to the guide (22).

The male part (3) has a pair of integrally and symmetrically shaped latching elements (31) which can be inserted in the hollow inside of the female part (2) with their shaped hooks (311) at ends clasping on the edge of the openings (21) of the female part (2) to joint the two parts together. Besides, the male part (3) has a pair of integrally shaped locking elements (32) between the two latching elements (31) so that in buckling action the locking elements (32) can properly lock corespondingly the latching elements (31).

The embodiment mentioned above summarizes the components of the invention and the relationship and relative positions between them.

Next, the operation principle of the invention is described refering to the figures given. Similar to a common buckle, in buckling action of the male part (3) and the female part (2), the male part (3) can be joined with the female part (2) through the shaped hooks (311) at the ends of the clasping elements (31) clasped on the edge of the openings (21) of the female part (2) and, the difference from a common buckle is that when the male part (3) reaches a preset depth in the female part (2), and as soon as the two locking elements (32) come into contact with the pushing/pulling element (243) of the compressive device (24) of the female part (2), the two locking elements (32) will be split apart by the slope of the pushing/putting element (243) and move in a cuving form until they press corespondingly against the two latching elements (31) while the male part (3) and the female part (2) get into a snapping position so that a secure buckling joint may be ensured. Even if an accidental depression is imposed on, the clasping elements (3l) will not be out of the buckling joint with the openings (21) due to an effective locking action from the two locking elements (32).

To sum up, the disclosed construction by the practical example of the invention provides by means of a simple design a locking mechanism which prevents the male and female parts in buckling status from possibly accidental separation and can be used in different buckling purposes where different buckling effects are required through changing the compression force of the spring. So, an excellent buckling effect may be obtained even if an undesired depression is imposed on the buckle, therefore, accidental goods losing can be avoided. Thus, the invention presents certainly its "industrial utility". In addition, the disclosed construction by the practical example of the invention has never been discovered or used in public, furthermore, has actually the improved function so that the invention presents also its "novelty and progressiveness".

I claim:

1. A side release buckle comprising:

a female part which is made hollow with a shaped opening properly at each side; and a male part which has a pair of integrally and symmetrically shaped latching elements which can be inserted in the hollow inside of the female part with shaped hooks at ends clasping on an edge of the opening of the female part to join the female part and the male part together;

wherein the male part has a pair of the integrally shaped locking elements between the two latching elements so that the locking elements can properly lock the latching elements;

wherein the female part has an integrally shaped guide in an internal wall thereof and a retainer located near a bottom of said female part for retaining a compressive device which consists of a spindle, a compression spring, and a wedge-shaped element, with the compression spring and the wedge-shaped element being placed over the spindle such that the wedge-shaped element is capable of moving along a direction;

male part capable of reaching a preset depth in the course of buckling action such that the locking elements come into contact with the wedge-shaped element of the compressive device of the female part, and that the locking elements move apart by a slope of the wedge-shaped element so as to move in a curving form until the locking elements press against the latching elements, and further that the male part and the female part are buckled.

* * * * *